US006610952B2

(12) United States Patent
Crevling

(10) Patent No.: US 6,610,952 B2
(45) Date of Patent: Aug. 26, 2003

(54) VACUUM CLEANER ACTUATOR SWITCH

(75) Inventor: Robert Lent Crevling, Williamsport, PA (US)

(73) Assignee: Shop Vac Corporation, Williamsport, PA (US)

( * ) Notice: Subject to any disclaimer, the term of this patent is extended or adjusted under 35 U.S.C. 154(b) by 255 days.

(21) Appl. No.: 09/737,982

(22) Filed: Dec. 15, 2000

(65) Prior Publication Data

US 2002/0074219 A1 Jun. 20, 2002

(51) Int. Cl.[7] ..... H01H 13/00; H01H 13/14

(52) U.S. Cl. ..... 200/552; 200/61.2; 200/61.86; 200/84 R

(58) Field of Search ..... 200/61.2, 61.21, 200/61.41, 61.86, 84 A, 84 R, 329, 330, 334, 552

(56) References Cited

U.S. PATENT DOCUMENTS

| | | | | |
|---|---|---|---|---|
| 1,661,480 A | | 3/1928 | Keefer | |
| 1,691,164 A | | 11/1928 | Monk | |
| 1,982,345 A | | 11/1934 | Kirby | |
| 3,866,470 A | * | 2/1975 | Miller | 73/313 |
| 4,080,104 A | | 3/1978 | Brown, Jr. | |
| 4,179,768 A | | 12/1979 | Sawyer | |
| 4,246,676 A | | 1/1981 | Hallsworth et al. | |
| 4,723,337 A | | 2/1988 | Ellison et al. | |
| 5,287,590 A | | 2/1994 | Yonkers et al. | |
| 5,349,722 A | | 9/1994 | Chayer | |
| 5,435,181 A | * | 7/1995 | Koebernik | 73/313 |
| 5,465,455 A | | 11/1995 | Allen | |
| 5,555,597 A | | 9/1996 | Berfield | |
| 5,655,650 A | * | 8/1997 | Naitou | 200/553 |
| 5,715,568 A | | 2/1998 | Berfield et al. | |
| 5,850,668 A | | 12/1998 | Berfield et al. | |
| 5,918,344 A | | 7/1999 | Crevling, Jr. et al. | |
| 5,920,955 A | | 7/1999 | Berfield | |
| 5,966,775 A | | 10/1999 | Berfield | |
| 6,009,596 A | | 1/2000 | Buss et al. | |
| 6,049,940 A | | 4/2000 | Robitaille | |
| 6,069,330 A | * | 5/2000 | Crevling, Jr. et al. | 200/84 R |
| 6,079,076 A | | 6/2000 | Berfield | |
| 6,112,366 A | | 9/2000 | Berfield | |
| 6,119,304 A | | 9/2000 | Berfield et al. | |

* cited by examiner

*Primary Examiner*—Karl D. Easthom
*Assistant Examiner*—Kyung Lee
(74) *Attorney, Agent, or Firm*—Marshall, Gerstein & Borun

(57) ABSTRACT

A switch assembly for a wet/dry vacuum cleaner is disclosed. The switch assembly includes a switch having a movable arm to connect first and second conductive terminals with a rocker arm pivotally attached to the switch. The rocker arm is operable by an actuator button and a de-actuator button which are user engageable. Depending upon which of the de-actuator and actuator buttons are depressed, the rocker arm assumes a given position relative to the switch, which in turn results in an on or off position for the switch. An automatic shut-off assembly is operable in conjunction with the switch assembly to turn the switch to an off position in the event that the level of liquid within the tank rises beyond an acceptable level. The switch assembly enables the operator to manually override the automatic shut-off assembly.

15 Claims, 8 Drawing Sheets

20
88
26
30
24
22
28
28

VACUUM CLEANER ACTUATOR SWITCH

FIELD OF THE INVENTION

The invention generally relates to wet/dry vacuum cleaners and, more particularly, relates to actuator switches for wet/dry vacuum cleaners having a pumping capability.

BACKGROUND OF THE INVENTION

Wet/dry vacuum cleaners are well-known. Such devices typically include a tank to which a removable lid is attached. A motor driven impeller is typically mounted within the lid to generate low pressure within the tank and thus create a vacuum for drawing matter in solid, liquid, and/or gaseous form therein.

Once the tank is filled, the user is confronted with the obstacle of emptying the tank, which can be unwieldy and heavy once filled. Conventionally, operators are provided with two options: one, the lid can be removed, and the tank can be tilted to empty its contents; and two, a drain provided at the bottom of the tank can be opened to drain the liquid therefrom. Such a latter option is viable only in the event that a suitable floor drain is provided.

Recently, certain wet/dry vacuum cleaners have been provided with a pumping capability. Therefore, in addition to being provided with an impeller to draw matter into the tank, a pump having an impeller typically mounted to the same motor shaft as that driving the vacuum impeller, is provided to evacuate or discharge liquid matter from the tank. One example of such a device is disclosed in U.S. Pat. No. 6,009,596 assigned to the present assignee, and expressly incorporated herein by reference.

With such wet/dry vacuum cleaners which include pumping capability, it is important that the level of liquid within the tank does not rise to the level of the vacuum impeller. Accordingly, such devices are typically provided with an automatic shut-off mechanism which severs power to the motor in the event that the level of liquid in the tank exceeds a safe margin. Upon triggering the automatic shut-off, the operator is then typically provided with an override capability which enables the pump to discharge liquid after the user has manually removed the vacuum intake from the source of liquid or debris.

SUMMARY OF THE INVENTION

In accordance with one aspect of the invention, a wet/dry vacuum cleaner switch assembly is provided which includes a switch, a rocker arm, an actuator, a de-actuator, a float, and a tie rod. The switch has first and second spaced terminals and a spring biased momentary arm. The spring biased momentary arm is adapted to move from an on position connecting the first and second spaced terminals to an off position disconnecting the first and second spaced terminals. The rocker arm is pivotally associated with the switch and includes an engagement surface adapted to move the momentary arm from the off position to the on position. The actuator is operatively associated with the rocker arm and is user engageable to move the rocker arm. The movement of the rocker arm by the actuator causes the engagement surface to move the momentary arm from the off position to the on position. The de-actuator is operatively associated with the rocker arm and is user engageable to move with the rocker arm. Movement of the rocker arm by the de-actuator causes the engagement surface to disengage from the momentary arm, while the engagement of the engagement surface with the momentary arm causes the spring biased momentary arm to move from the on position to the off position. The tie rod is connected between the float and the rocker arm. Upward movement of the float causes the tie rod to pivot the rocker arm which in turn causes the momentary arm to move from the on position to the off position.

In accordance with another aspect of the invention, a wet/dry vacuum cleaner is provided which comprises a tank, a removable lid, a motor, a vacuum impeller, a pump impeller, a switch assembly, a float, and a tie rod. The tank has an open top with the removable lid being attached to the open top. A motor positioned within the lid includes a shaft extending therefrom. A vacuum impeller and pump impeller are attached to the motor shaft. The switch assembly is connected to the motor and includes a rocker arm. The float is disposed within the tank and the tie rod is connected between the switch assembly and the float.

In accordance with another aspect of the invention, a wet/dry vacuum cleaner of the type having a tank, a motor, a vacuum impeller connected to the motor, a pump impeller connected to the motor, a switch connected to the motor and a float assembly disposed from the tank and connected to the switch is provided which includes a manual override switch assembly having a rocker arm, an actuator button, and a de-actuator button. The rocker arm is operatively associated with the switch, the switch includes a movable element adapted to open or close the switch. The rocker arm is adapted to move the movable element and includes first and second ends. The actuator button is operatively associated with the rocker arm first end and the de-actuator button is operatively associated with the rocker arm second end.

In accordance with another aspect of the invention, a wet/dry vacuum cleaner switch assembly is provided which comprises a rocker switch adapted to pivot from an on position to an off position, and a buoyant float connected to the rocker switch and adapted to move the rocker switch from the on position to the off position.

These and other aspects and features of the invention will become more apparent from the following detailed description when taken in conjunction with the accompanying drawings.

Figure 1:
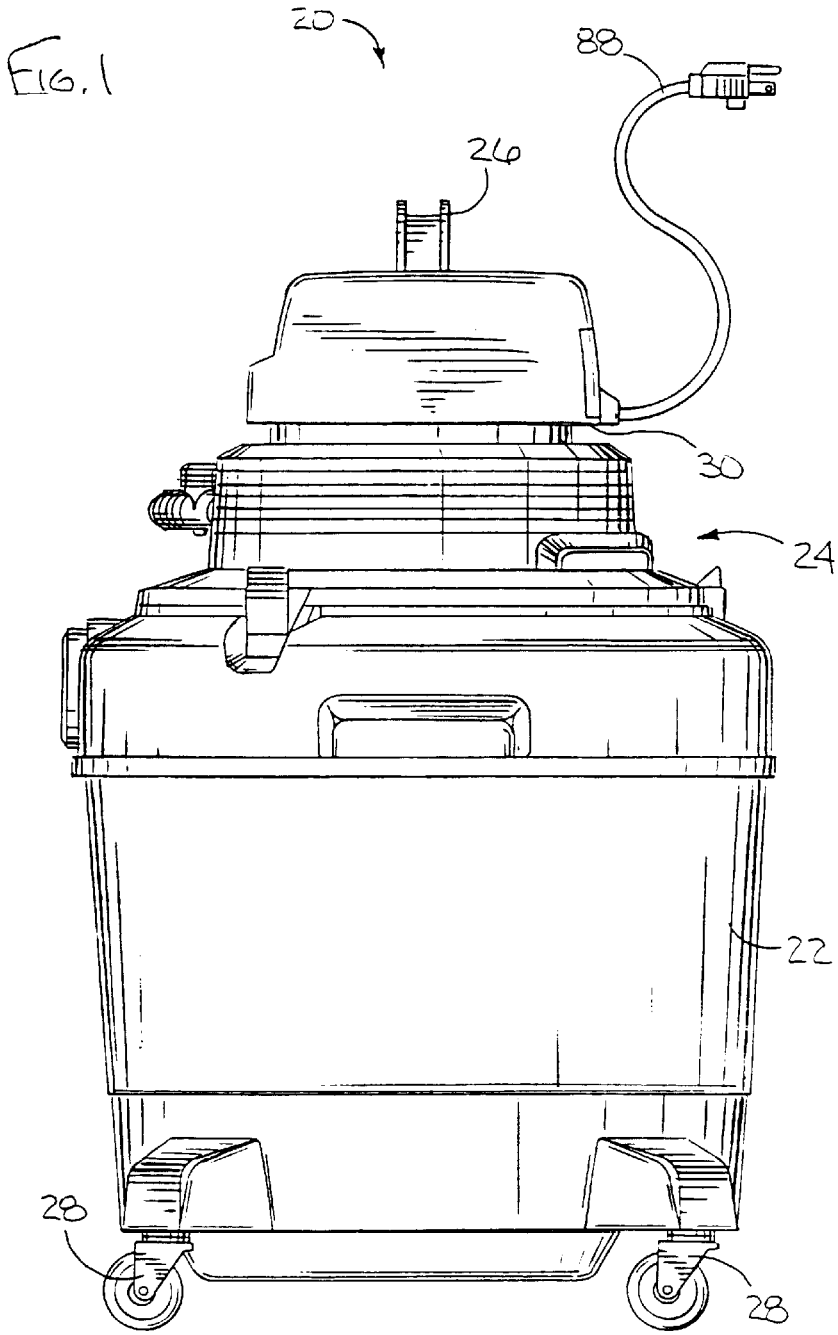
FIG. 1 is a side view of a wet/dry vacuum cleaner constructed in accordance with the teachings of the invention.

While the invention is susceptible to various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions and equivalents falling within the spirit and scope of the invention as defined by the appended claims.

DETAILED DESCRIPTION OF THE PREFERRED EMBODIMENTS

Referring now to the drawings, and with specific reference to FIG. 1, a wet/dry vacuum cleaner constructed in accordance with the teachings of the invention is generally depicted by reference numeral 20. While the vacuum cleaner depicted is of a wet/dry vacuum cleaner type, it is to be understood that the switch assembly of the invention can be employed with other types of vacuum cleaners and pumps as well.

As shown in FIG. 1, the vacuum cleaner 20 includes a tank 22 to which a lid assembly 24 is removably attached. The lid assembly 24 includes a handle 26 to facilitate moving the vacuum cleaner 20 as well as removal of the lid assembly 24. A plurality of casters or other types of wheels 28 are attached to the tank 22 to also facilitate movement.

Figure 2:
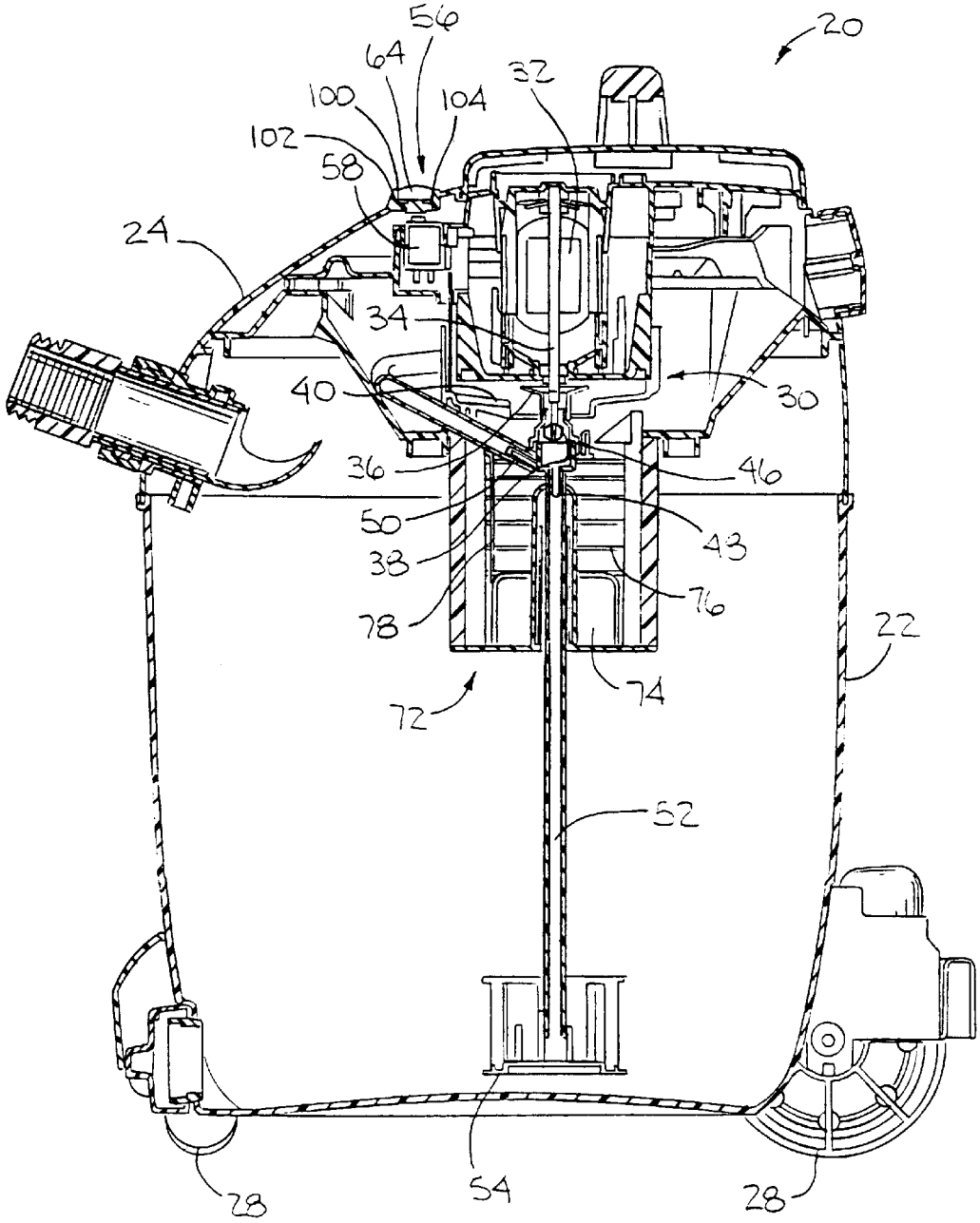
FIG. 2 is a sectional, partially cut-away view of a tank, lid, power assembly, float, and switch assembly constructed in accordance with the teachings of the invention.

Turning now to FIG. 2, it can be seen that a power assembly 30 is mounted within the lid assembly 24. More specifically, the power assembly 30 includes a motor 32 from which a rotatable shaft 34 extends. A vacuum impeller 36 is mounted to the shaft 34 with a pump impeller 38 being mounted below the vacuum impeller 36. Accordingly, upon energization of the motor 32, both the vacuum impeller 36 and pump impeller 38 rotate with the shaft 34. The vacuum impeller 36 is mounted for rotation within a shroud 40. Rotation of the vacuum impeller 36 within the shroud 40 creates a low pressure within the tank 22 thereby drawing matter into the tank 22.

The pump impeller 38 is mounted for rotation within a chamber 46. The chamber 46 includes an inlet 48 and an outlet 50. An intake tube 52 extends downwardly from the inlet 48 into the tank 22 and terminates in a pump intake assembly 54.

In order to energize the motor 32, a switch assembly 56 is provided. As shown in FIGS. 3–7, the switch assembly 56 includes a switch 58 to which a rocker arm 60 is pivotally attached at a pivot 62. The switch assembly 56 also includes an actuator button 64 and a de-actuator button 66. The actuator button 64 is mounted for reciprocating motion proximate a first end 68 of the rocker arm 60, while the de-actuator button 66 is mounted for reciprocating motion proximate a second end 70 of the rocker arm 60. The switch assembly 56 also includes an automatic shut-off assembly 72 which includes a float 74 mounted for linear motion within a cage 76 and a tie rod 78 connecting the float 74 to the rocker arm 60.

Figure 9:
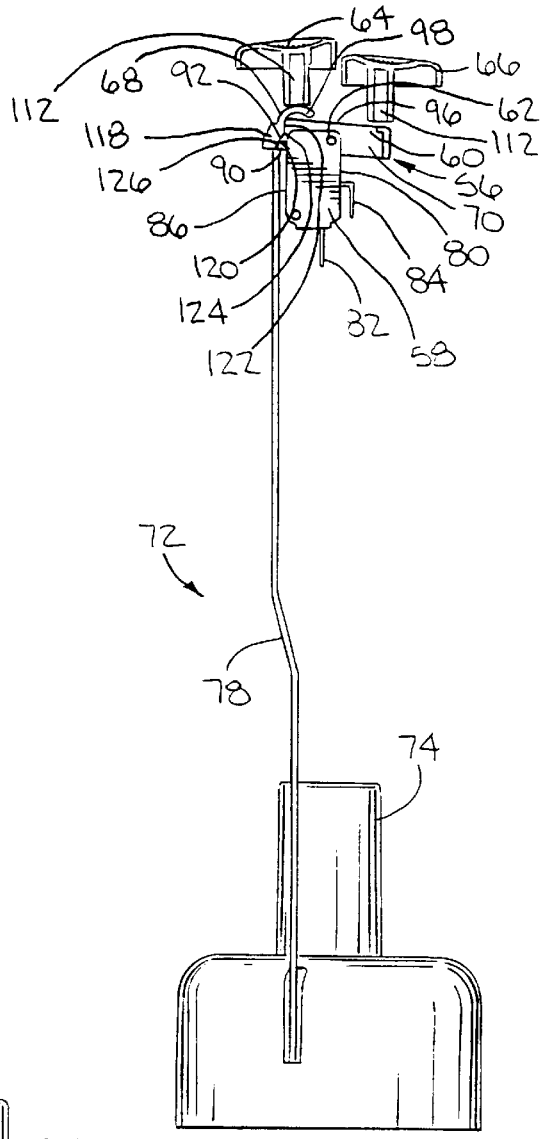
FIG. 9 is a side view of FIG. 8.

With reference now to FIG. 9, the switch 58 is shown to include a housing 80 from which first and second terminals 82, 84 extend. A momentary or movable arm (not shown) is mounted within the switch housing 80 and is adapted to move from a first or on position connecting the terminals 82, 84, to a second or off position disconnecting the terminals 82 and 84. 20 The movable arm, and first and second terminals 82 and 84 are manufactured of a suitable electrically conductive material, such as copper, such that when the movable arm is in the on position, the terminals 82, 84 are connected and a circuit is completed to thereby connect a power cord 88 (FIG. 1) to the motor 32 (FIG. 2) for energization thereof. The movable arm is preferably spring biased into the off position. An actuator tab 90 extends from the movable arm outward through the housing 80 to engage the rocker arm 60 to engage the movable arm 86 as will be described in further detail herein. The switch 58, in a preferred embodiment, is provided in the form of a Unimax model no. TMCJG6SP0040Y switch manufactured by C & K/Unimax Inc. of Willingford, Conn.

Figure 8:
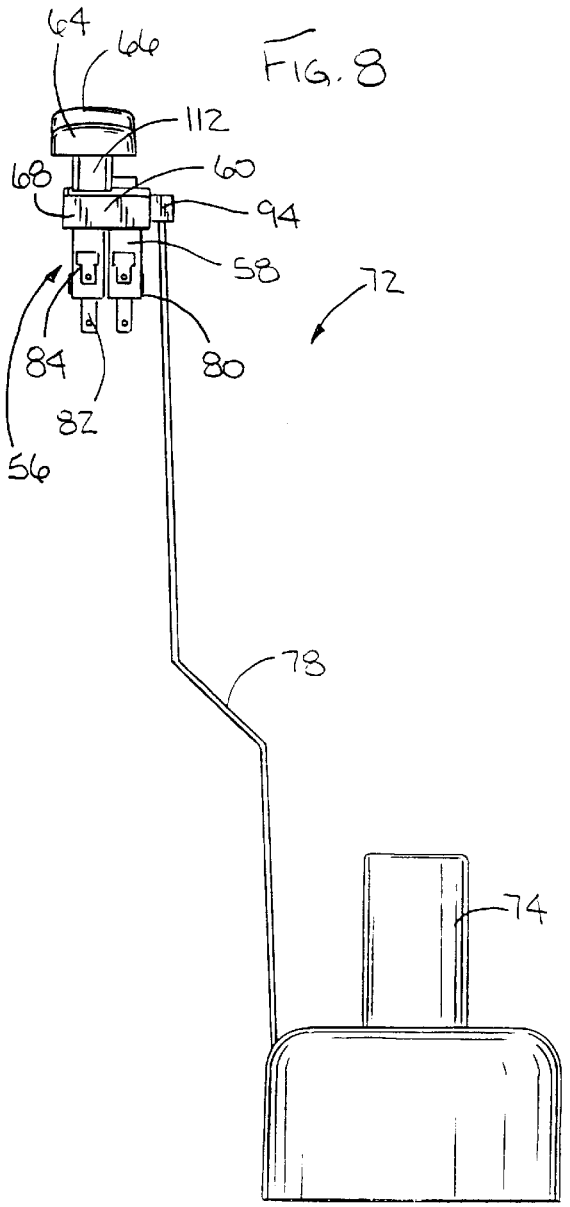
FIG. 8 is an end view of a switch assembly and an automatic shut-off assembly constructed in accordance with the teachings of the invention.

Referring now to FIG. 8, the rocker arm 60 is illustrated to include a receptacle 94 which receives the tie rod 78. The receptacle 94 is preferably integrally molded with the rocker arm 60 and extends laterally therefrom. The rocker arm 60 and receptacle 94 are preferably manufactured from a suitable plastic, such as ABS. Extending from a top surface 96 of the first end 68 of the rocker arm 60 is an extension arm 98, as shown best in FIG. 9. The extension arm 98 serves as an extension enabling contact of the actuator button 64 and the rocker arm 60, as will now be described.

As shown in FIGS. 3–7, each of the actuator button 64 and de-actuator button 66 is mounted within a recess 100 molded into the cover 101 of the lid assembly 24. The recess 100 includes an outer wall 102 and a floor 104. Each of the actuator button 64 and de-actuator button 66 includes a stem 112 (FIG. 9) extending through the floor 104. In the preferred embodiment, each of the actuator button 64 and de-actuator button 66 are biased by springs 105 into an extended position away from the floor 104.

Figure 3:
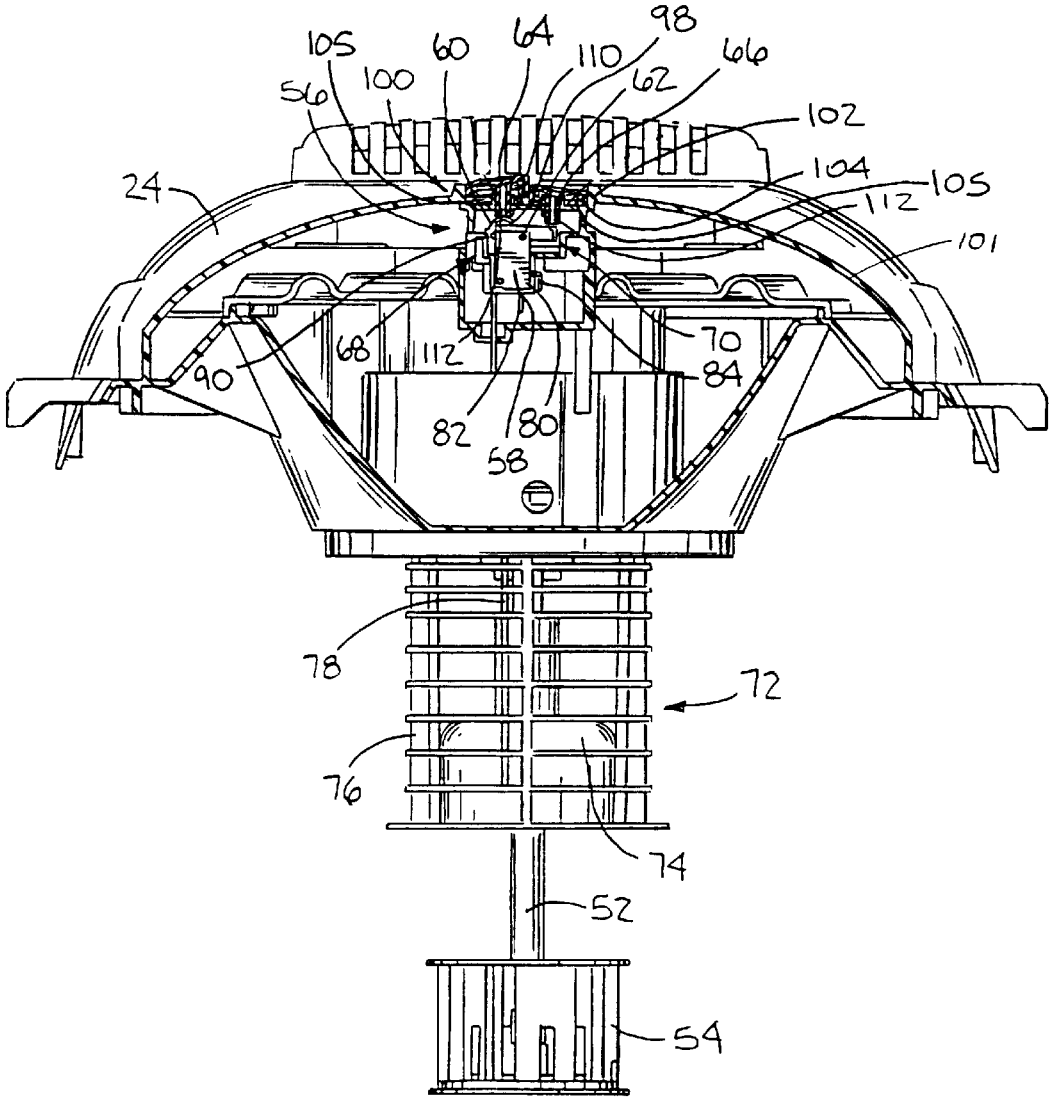
FIG. 3 is a side cut-away view of a lid, power assembly and switch assembly constructed in accordance with the teachings of the invention with the switch assembly shown in an off position.

In operation, the switch assembly 56 and shut-off assembly 72 function to actuate and de-actuate the vacuum motor 32 and thus the vacuum impeller 36 and pump impeller 38. With reference to FIG. 3, the switch assembly is depicted in an off position with the de-actuator button 66 depressed into the recess 100. This in turn presses the second end 70 of the rocker arm 60, which in turn raises the first end 68 of the rocker arm 60. In so doing, an engagement surface 118 (FIG. 9) extending from the rocker arm 60 pivots away from the actuator tab 90 of the switch 58. This in turn allows the biased movable arm of the switch 58 to disconnect the terminals 82, 84 to thereby open the switch 58 and de-actuate the motor 32.

Figure 4:
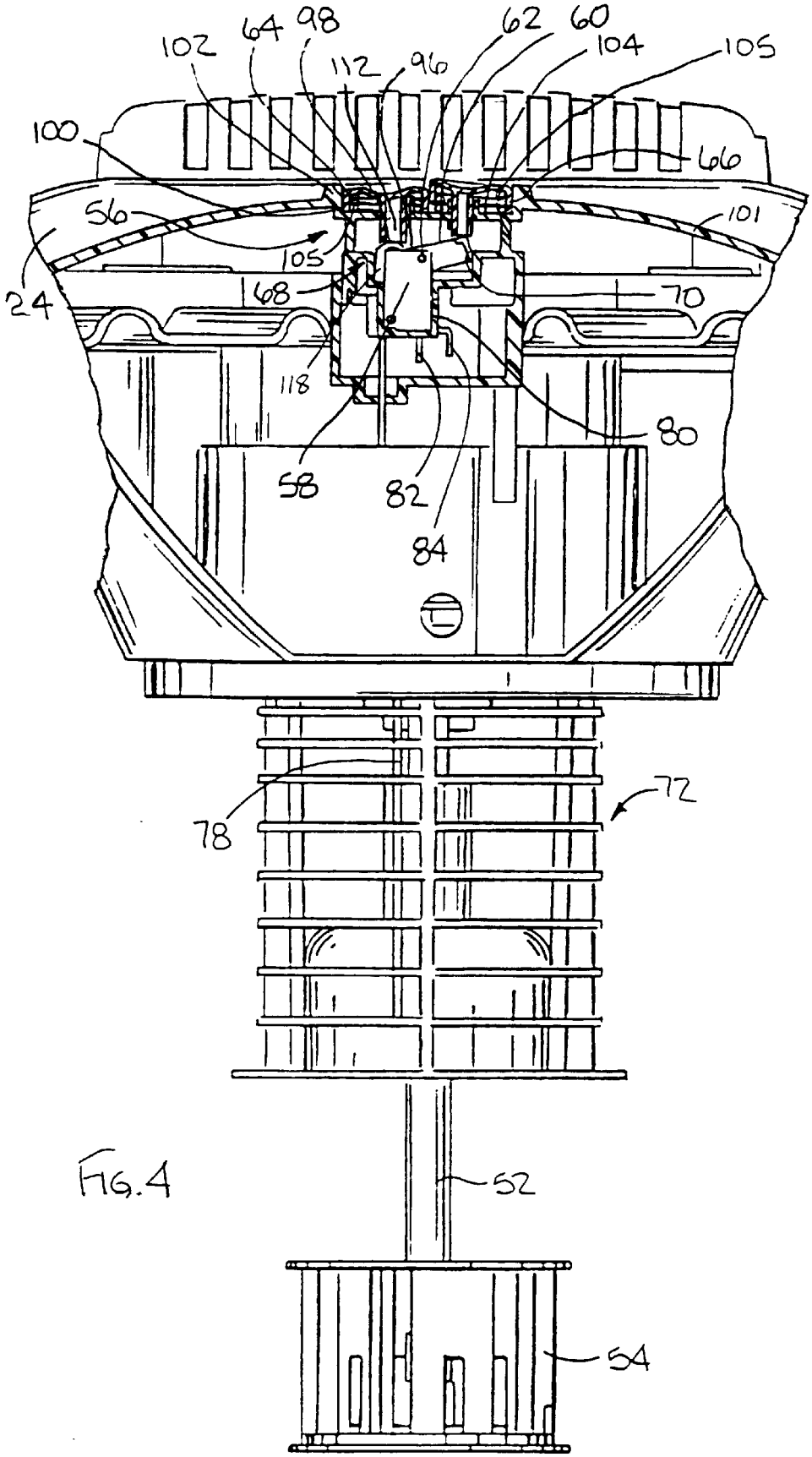
FIG. 4 is a side cut-away view of a lid, power assembly, and switch assembly constructed in accordance with the teachings of the invention with the switch assembly shown in an on position.

When it is desired to operate the vacuum impeller 36 and/or pump impeller 38, the actuator button 64 is depressed into the recess 100, as shown in FIG. 4. This in turn causes the stem 112 of the actuator button 64 to act upon the extension arm 98 of the rocker arm 60. In turn, the first end 68 of the rocker arm 60 is pivoted downwardly which in turn causes the engagement surface 118 to pivot inwardly and push the actuator tab 90 of the switch 58 inwardly. This in turn causes the movable arm to connect the terminals 82 and 84, thereby completing a circuit and actuating the motor 32.

To facilitate this motion, the engagement surface 118 includes a cam surface 120 and a locking ledge 122 which meet at a juncture 124, as shown best in FIG. 9. By providing the canted or angled cam surface 120, the engagement surface 118 is able to slide relative to the actuator tab 90 while pivoting inwardly toward the switch 58 and thereby depressing the actuator tab 90 inwardly. In order to maintain the actuator tab 90 in the inward or on position, the locking ledge 122 is shaped and spaced away from the switch 58 sufficiently to maintain the on position. More specifically, once the juncture 124 of the engagement surface 118 moves past the actuator tab 90, the locking ledge 122 is provided at a minimal angle to an end 126 of the actuator tab 90 such that the outward biasing force generated by the movable arm is imparted on the angled surface of the locking ledge 122 while tending to pivot the rocker arm 60 in the "on" direction thus providing a minimal force of rotation to hold pivot arm 60 (against a stop) in the "on" position. In order to move the switch assembly 56 from the on position depicted in FIG. 4, the user either needs to manually depress the de-actuator button 66 to the position shown in FIG. 3, or the automatic shut-off assembly 72 needs to operate to force the switch assembly 56 into the position depicted in FIG. 5.

Figure 5:
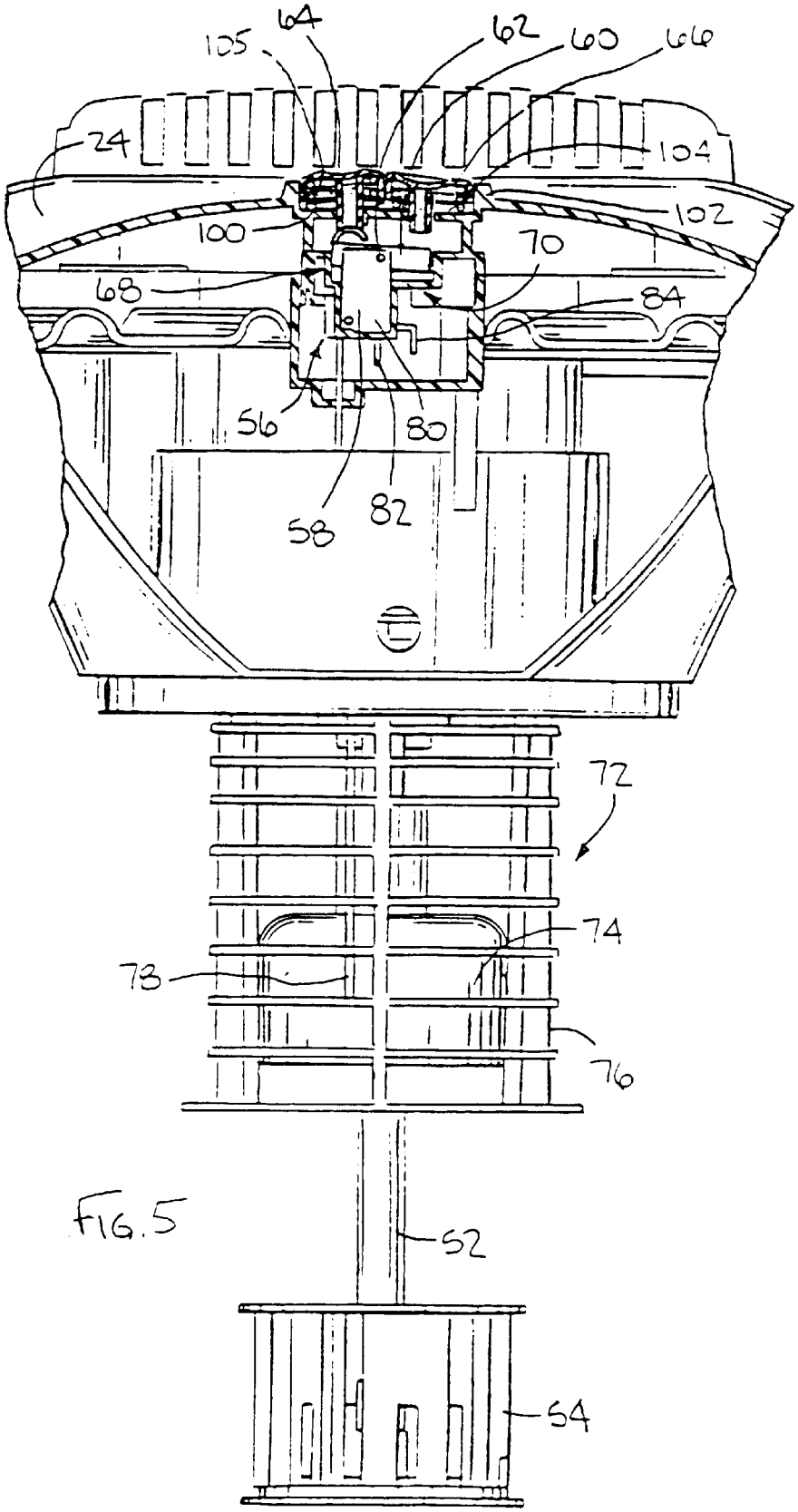
FIG. 5 is a side cut-away view of a lid, power assembly, and switch assembly constructed in accordance with the teachings of the invention with the switch assembly depicted in automatic shut-off position.

Operation of the automatic shut-off assembly 72 is as shown in FIG. 5, wherein the first end 68 of the rocker arm 60 has pivoted upwardly. Such upward movement of the rocker arm 60 and first end 68 causes the engagement surface 118 to move out of contact with the actuator tab 90, which in turn moves the movable arm 86 out of contact with the terminals 82 and 84, thereby de-activating the motor 32. The force causing the upward movement of the first end 68 of rocker arm 60 is generated by the float 74, which in turn is imparted to the rocker arm 60 by the tie rod 78. As shown in FIG. 5, when the amount of liquid within the tank 22 rises so as to contact the float 74, the float 74 can rise within the cage 76 with the rising liquid. The upward buoyant force generated by the float 74 is sufficiently stronger than the frictional and rotational force generated between the locking ledge 122 and actuator tab 90 to thereby force the first end 68 of the rocker arm 60 upwardly.

Even after the automatic shut-off assembly 72 has functioned to de-energize the motor 32 and thereby prevent further liquid from being brought into the tank 22, the motor 32 can again be energized if the user so desires. Before doing so, the user would typically remove the vacuum hose (not shown) from the source of liquid being vacuumed. Accordingly, once the motor 32 is energized, even though the vacuum impeller 32 is rotating, only the pump impeller 38 would actually be drawing fluid therethrough to thereby lower the level of liquid within the tank 22.

Figure 6:
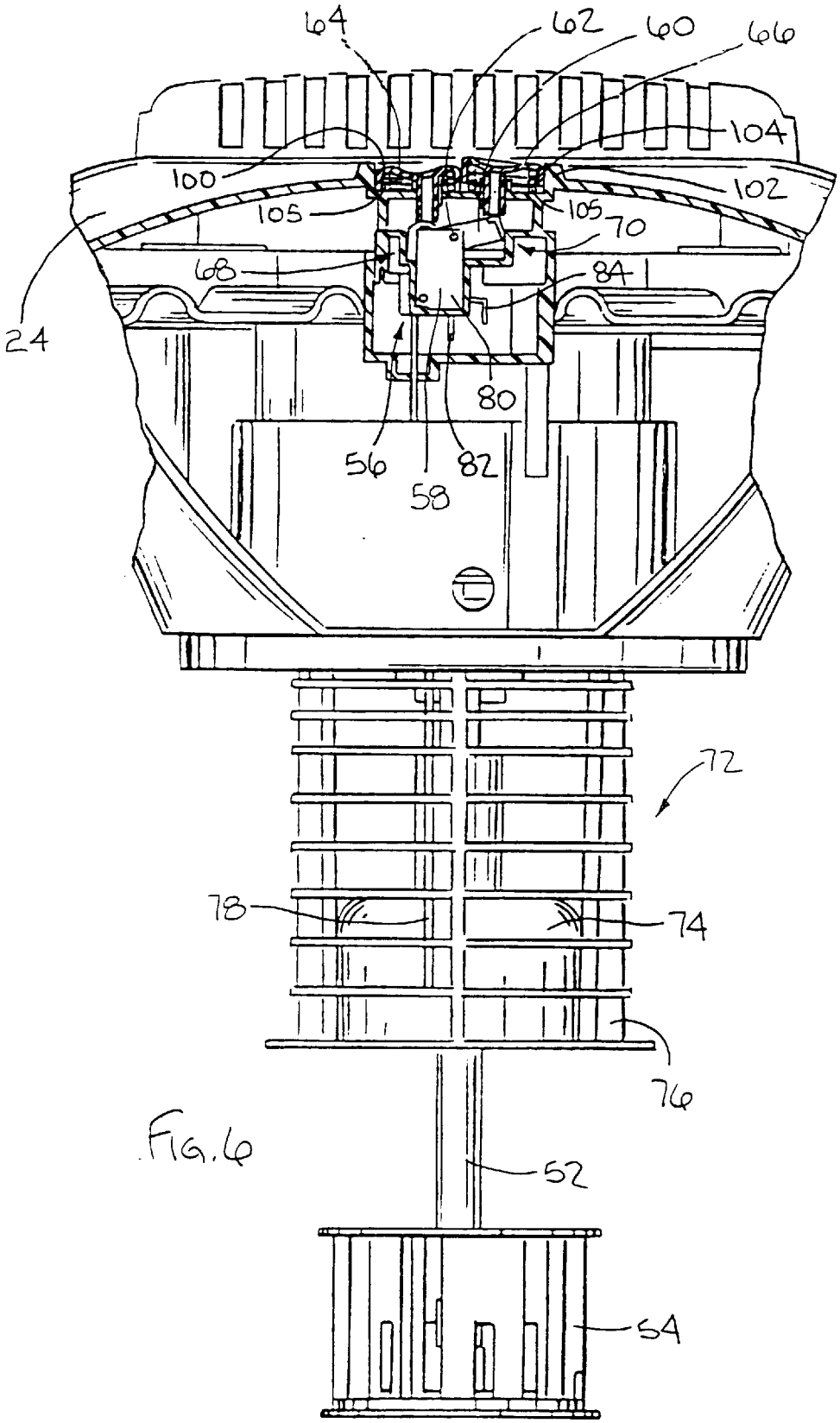
FIG. 6 is a side cut-away view of a lid, power assembly, and switch assembly constructed in accordance with the teachings of the invention with the switch assembly shown in an override position.
Figure 7:
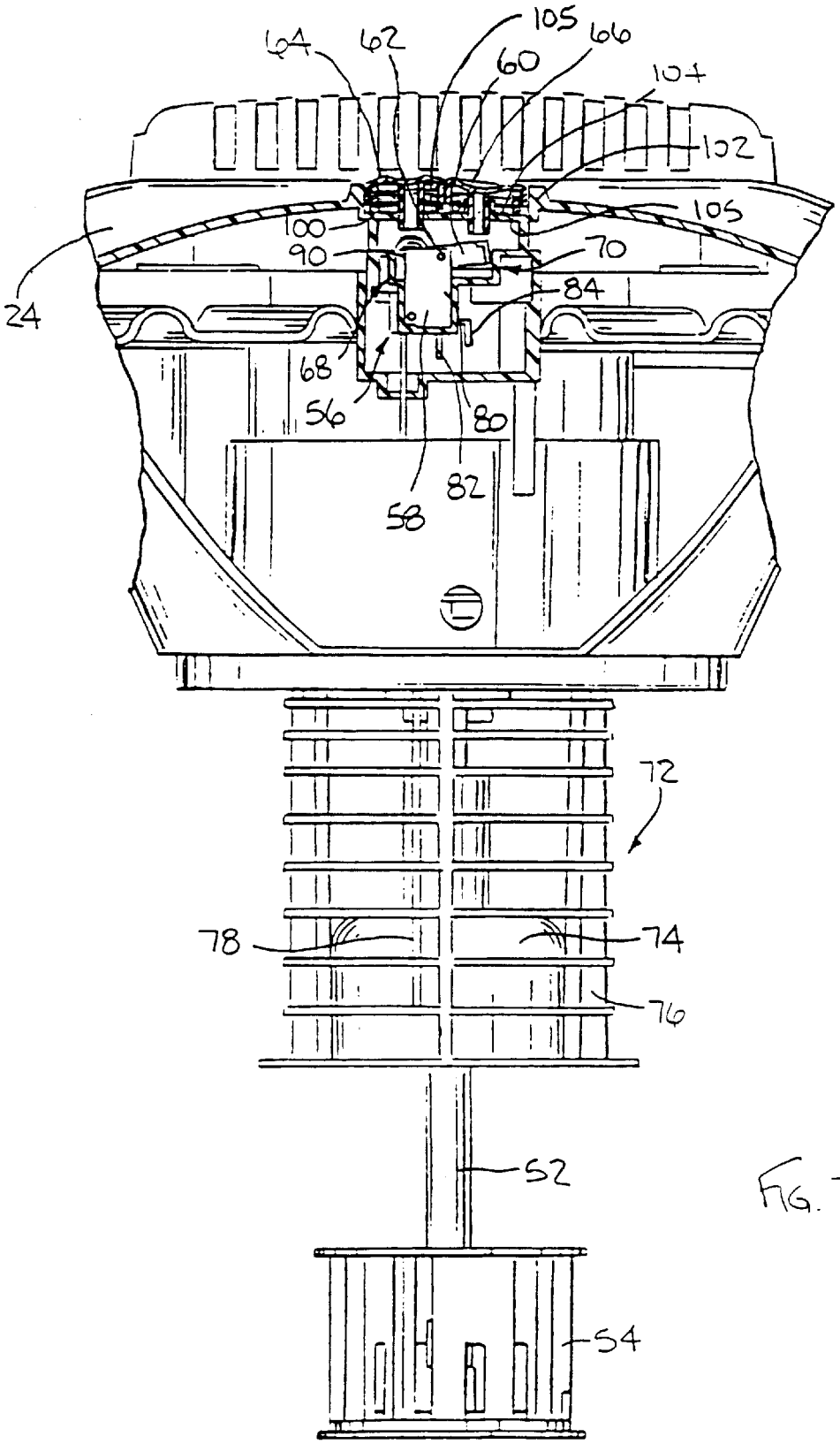
FIG. 7 is a side cut-away view of a lid, power assembly, and switch assembly constructed in accordance with the teachings of the invention with the switch assembly depicted in an on position with actuator and de-actuator buttons biased outwardly to the same height.

In order to manually override the automatic shut-off assembly 72, the user simply depresses the actuator button 64 with sufficient force to overcome the buoyant force generated by the float 74. The operator is required to continually depress the actuator button 64, otherwise the buoyant force of the float 74 again returns the switch assembly 56 to the shut-off position depicted in FIG. 5, at least until the level of fluid within the tank has dropped below the level of the float 74. This override position is depicted in FIG. 6. Once the level of liquid within the tank 22 has dropped below the float 74, the float 74 rests upon the bottom of the cage 76 with the tie rod 78 positioned without contact with the rocker arm 60. This allows the switch assembly 56 to remain in the "on" position when actuator button 64 is released (FIG. 7). As shown therein, the stems 112 of the actuator and de-actuator buttons 64 and 66 rest above their respective contact portions of the rocker arm 60. This can be accomplished by biasing the buttons 64, 66 upwardly by the springs 105, and does not apply undesirable influence to rocker arm 60 during operation. The actuator button 64 and the de-actuator button 66 are thereby caused to be equidistantly raised within the recess 100. The operator can then reposition the vacuum hose for both vacuum and pumping operation.

From the foregoing, it can be appreciated by one of skill in the art that the invention provides a switch assembly for a wet/dry vacuum cleaner having vacuum and pumping capability, with an automatic shut-off and manual override capability as well.

What is claimed is:

1. A wet/dry vacuum cleaner switch assembly, comprising:

a switch, the switch having first and second spaced terminals and a momentary arm, the momentary arm adapted to move from an on position connecting the first and second spaced terminals to an off position disconnecting the first and second spaced terminals;

a rocker arm pivotally associated with the switch, the rocker arm having an engagement surface adapted to move the momentary arm from the off position to the on position;

an actuator operatively associated with the rocker arm, the actuator being user engageable to move the rocker arm, movement of the rocker arm by the actuator causing the engagement surface to move the momentary arm from the off position to the on position;

a de-actuator operatively associated with the rocker arm, the de-actuator being user engageable to move the rocker arm, movement of the rocker arm by the de-actuator causing the engagement surface to disengage from the momentary arm, disengagement of the engagement surface with momentary arm causing the momentary arm to move from the on position to the off position;

a float; and a tie rod connected between the float and the rocker arm, upward movement of the float causing the tie rod to pivot the rocker arm, pivoting of the rocker arm causing the momentary arm to move from the on position to the off position.

2. The wet/dry vacuum cleaner switch assembly of claim 1, wherein the rocker arm engagement surface includes a cam surface and a locking ledge, the cam surface facilitating movement of the rocker arm relative to the momentary arm, the locking ledge locking the momentary arm in the on position.

3. The wet/dry vacuum cleaner switch assembly of claim 1, wherein the actuator and the de-actuator are biased into neutral positions.

4. A wet/dry vacuum cleaner, comprising:

a tank having an open top;

a removable lid attached to the tank open top;

a motor positioned within the lid, a shaft extending from the motor;

a vacuum impeller attached to the shaft;

a pump impeller attached to the shaft;

a switch assembly connected to the motor, the switch assembly including a rocker arm;

a float disposed within the tank; and a tie rod connected between the switch assembly and the float.

5. The wet/dry vacuum cleaner of claim 4, wherein the switch assembly further includes a switch having first and second terminals and a movable arm, the movable arm being movable between on and off positions, the movable arm connecting the first and second terminals when in the on position, the movable arm disconnecting the first and second terminals when in the off position.

6. The wet/dry vacuum cleaner of claim 5, wherein an engagement surface extends from the rocker arm, the rocker arm being movable between on and off positions, the engagement surface forcing the movable arm into the on position when the rocker arm is in the engagement position, the switch including a spring to force the movable arm into the off position when the rocker arm is in the off position.

7. The wet/dry vacuum cleaner of claim 6, wherein the engagement surface includes a cam surface adjacent a locking ledge, the cam surface facilitating sliding motion of the engagement surface against the movable arm when the rocker arm moves from the off position to the on position.

8. The wet/dry vacuum cleaner of claim 7, wherein the float is disposed within a cage disposed within the tank, the float being adapted to move linearly within the cage as the level of liquid within the tank rises and falls, movement of the float causing movement of the tie rod, rocker arm, and movable arm.

9. The wet/dry vacuum cleaner of claim 8, further including on and off actuator buttons mounted through the lid, each button including top and bottom ends, the top ends being user engageable, the bottom ends being engageable with the rocker arm.

10. The wet/dry vacuum cleaner of claim 9, further including springs biasing the on and off buttons away from the lid into neutral positions.

11. In a wet/dry vacuum cleaner of the type having a tank, a motor, a vacuum impeller connected to the motor, a pump impeller connected to the motor, a switch connected to the motor, and a float assembly disposed within the tank and connected to the switch, a manual override switch assembly, comprising:

a rocker arm operatively associated with the switch, the switch having a movable element adapted to open or close the switch, the rocker arm being adapted to move the movable element, the rocker arm having first and second ends;

an actuator button operatively associated with the rocker arm first end; and a de-actuator button operatively associated with the rocker arm second end.

12. The wet/dry vacuum cleaner of claim 11, wherein the switch includes a spring biasing the movable element into an open position.

13. The wet/dry vacuum cleaner of claim 12, wherein the rocker arm includes an engagement surface adapted to move the movable element into a closed position when the rocker arm first end and actuator button are depressed.

14. The wet/dry vacuum cleaner of claim 13, wherein the engagement surface includes a cam surface and a locking ledge, frictional interference between the locking ledge and movable element retaining the movable element in the closed position when the rocker arm first end and actuator button are depressed.

15. The wet/dry vacuum cleaner of claim 12, wherein the actuator button and de-actuator button are biased away from the rocker arm.

* * * * *